US006988589B2

(12) United States Patent
Ribic

(10) Patent No.: US 6,988,589 B2
(45) Date of Patent: Jan. 24, 2006

(54) RAPPELLING DEVICE FOR PERMITTING PERSONS TO BE RESCUED FROM HIGH BUILDINGS, TOWERS OR THE LIKE

(76) Inventor: Harold Ribic, Erdelhofstrasse 7, 44357 Dortmund (DE)

( * ) Notice: Subject to any disclaimer, the term of this patent is extended or adjusted under 35 U.S.C. 154(b) by 10 days.

(21) Appl. No.: 10/493,337

(22) PCT Filed: Oct. 19, 2002

(86) PCT No.: PCT/EP02/11724

§ 371 (c)(1),
(2), (4) Date: Apr. 22, 2004

(87) PCT Pub. No.: WO03/041799

PCT Pub. Date: May 22, 2003

(65) Prior Publication Data

US 2004/0245048 A1 Dec. 9, 2004

(30) Foreign Application Priority Data

Oct. 25, 2001 (DE) ..... 201 17 299 U
Jan. 10, 2002 (DE) ..... 202 00 300 U

(51) Int. Cl.
*A62B 1/10* (2006.01)

(52) U.S. Cl. ..... 182/235

(58) Field of Classification Search ..... 182/235, 182/3, 6, 231, 232, 233, 234, 191, 192, 193, 182/70–73; 254/384–391; 188/65.2–65.4

See application file for complete search history.

(56) References Cited

U.S. PATENT DOCUMENTS

| | | | |
|---|---|---|---|
| 2,358,825 | A | 1/1944 | Pribula |
| 2,500,884 | A | 3/1950 | Tessin |
| 2,729,425 | A | 1/1956 | Gschwind |

(Continued)

FOREIGN PATENT DOCUMENTS

| | | |
|---|---|---|
| CH | 4 99 988 | 1/1971 |
| DE | 30 28 586 | 2/1981 |
| DE | 31 42 146 | 5/1983 |

(Continued)

*Primary Examiner*—Hugh B. Thompson, II

(74) *Attorney, Agent, or Firm*—Collard & Roe, P.C.

(57) ABSTRACT

A solution is supposed to be achieved with a rappelling device (1) for permitting persons (3) to be rescued from high buildings, towers, and the like, having a suspension strap (2), suspension vest, or the like, to be worn by the person in question, wherein a rope container (8) having a device to release the rope length (4) is provided on the suspension strap (2), which solution is supposed to be easy to operate, on the one hand, and to be made available to the persons in question at any time, and easy to handle for them, whereby the person using the device can essentially move both hands freely, in a stable rappelling position.

This is achieved in that the rope drum (7) that forms the rope container (8), in the wearing position on the back of the person using the device, is provided with a rope guide device (13) for passing the rope to a release position in the chest region of the person using the device.

9 Claims, 5 Drawing Sheets

U.S. PATENT DOCUMENTS

| | | | | | |
|---|---|---|---|---|---|
| 4,130,176 | A | | 12/1978 | Paulie | |
| 4,301,892 | A | | 11/1981 | Arce | |
| 4,493,396 | A | | 1/1985 | Borgia | |
| 4,687,077 | A | * | 8/1987 | Bobick | 182/235 |
| 4,722,422 | A | | 2/1988 | Hiraoka | |
| 4,877,110 | A | * | 10/1989 | Wolner | 182/232 |
| 6,371,244 | B2 | * | 4/2002 | Okamura | 182/72 |

FOREIGN PATENT DOCUMENTS

| | | |
|---|---|---|
| DE | 36 40 057 | 6/1988 |
| DE | 40 19 558 | 1/1992 |
| DE | 195 11 117 | 9/1996 |
| GB | 2 232 608 | 12/1990 |
| GB | 2 316 382 | 2/1998 |

* cited by examiner

RAPPELLING DEVICE FOR PERMITTING PERSONS TO BE RESCUED FROM HIGH BUILDINGS, TOWERS OR THE LIKE

CROSS REFERENCE TO RELATED APPLICATIONS

Applicant claims priority under 35 U.S.C. §119 of German Applications No. 201 17 299.2, filed on Oct. 25, 2001 and No. 202 00 300.0, filed on Jan. 10, 2002. Applicant also claims priority under 35 U.S.C. §365 of PCT/EP02/11724 filed on Oct. 19, 2002. The international application under PCT article 21(2) was not published in English.

FIELD OF THE INVENTION

The invention relates to a rappelling device for permitting persons to be rescued from high buildings, towers, and the like, having a suspension strap, suspension vest, or the like, to be worn by the person in question, which is of the type indicated in claim 1, as it is described in GB-2 316 382-A or, in another construction, in U.S. Pat. No. 4,301,892-A, for example.

BACKGROUND OF THE INVENTION

During the catastrophe in the World Trade Center in New York on Sep. 11, 2001, caused by a terrorist attack, it became clear, once again, that persons who are located on the upper floors of buildings have no chance to be rescued. Since the possibility of getting out of a building by the elevator or stairs does not exist, or exists only insufficiently, in the case of a fire, as in other cases of catastrophe, the sole path of rescue remains through the windows, to the outside.

In addition to the possibilities indicated above, there are other approaches to rescuing persons outside of buildings, such as fire ladders, but they only make sense up to a certain building height, or, as described in DE-36 40 057-A1, endless ropes that are attached in front of the facade, into which people can hook on, in order to then slide down. Other rappelling devices, for which persons to operate these devices are required, as a rule, are shown by DE-30 28 586-C2, DE 31 42 146-A1, DE-40 19 558-A1, U.S. Pat. No. 4,493,396, or CH-4 99 988, essentially with braking devices on ropes, as by DE-195 11 117-A1. This rope and winch technology has significant disadvantages, since it is essentially not always available, or only at some locations of buildings and, as already mentioned above, frequently requires operating personnel in order to avoid malfunctions and therefore serious accidents of the persons using it.

Other systems are overhead rescue possibilities, for example in mountain rescues, in the case of bridges or high buildings, or in the rescue of people by helicopter, on which electrically operated rope winches are located, which are used to pull the person to be rescued up on a rope; this is a method that is generally much more complicated than the ones described above.

BRIEF SUMMARY OF THE INVENTION

This is where the invention starts, which has the task of creating a solution that is simple to operate, for one thing, and can be made available to the persons in question, at any time, and easily handled by them, for another thing, whereby the person using it can essentially move both hands freely, with a stable rappelling position.

This task is accomplished with a rappelling device of the type indicated initially, according to the invention, in that the rope drum that forms the rope container is provided, in the carrying position, on the back of the person using it, and has a rope guide device to pass the rope into a release position in the chest region of the person using it.

By means of the configuration of the rappelling device according to the invention, it is possible to keep this device available, in similar manner, on every floor of a high building, in sufficient numbers, as is done in the case of rescue devices on ships, i.e. in an emergency, every person can put on a corresponding suspension vest or suspension strap, and the rappelling device can be used, since its rope container is always kept automatically available.

In this connection, it is practical to place the location of the release of the rope, which is under great stress while rappelling, in the vicinity of the sternum of the person using it. This can be done, for one thing, by means of a chest pack, but another possibility is to pass the rope release location from a container to be strapped onto the back, between the legs of the person using it, for example through a tube-shaped guide device, to the region of the sternum, as the invention also provides.

This configuration also has the great advantage that no parts of the device that could block the view or be a hindrance are located in front of the person, and this greatly facilitates climbing out of a window or stepping over parapets.

Because of modern materials, such suspension ropes that serve only to rescue a person can be kept very thin, i.e. a corresponding container that allows rappelling down even from very high buildings is comparatively light and small and therefore easy to handle.

An embodiment of the invention consists of providing a braking device at the end of the rope guide device.

Other embodiments of the invention are evident from the dependent claims. One configuration possibility is, for example, to structure the rope container on the suspension belt as a rope drum that can be braked, another possibility is to provide the rope container on a drum and to provide a rope braking device independent of this.

The rope drum, with the braking device integrated into or separate, can be configured as a chest pack or a back pack, with the braking device that can be activated by the person using it.

The braking device can be configured as a lever-activated disk brake, as a stricture brake, or the like, as the invention also provides. In this connection, a stricture brake can be provided on a brake drum axle, whereby a hose filled with a fluid has pressure applied to it by squeezing elements on a cross handle or the like on the rope drum, and the flow through the hose system can be made easier or more difficult by the person using the device, by means of the handling element. A fluid brake as such is also described in U.S. Pat. No. 2,358,825, for example.

BRIEF DESCRIPTION OF THE DRAWINGS

Other characteristics, details, and advantages of the invention are evident from the following description, as well as from the drawing. This shows.

DETAILED DESCRIPTION OF THE INVENTION

Figures 1, 2, 3:
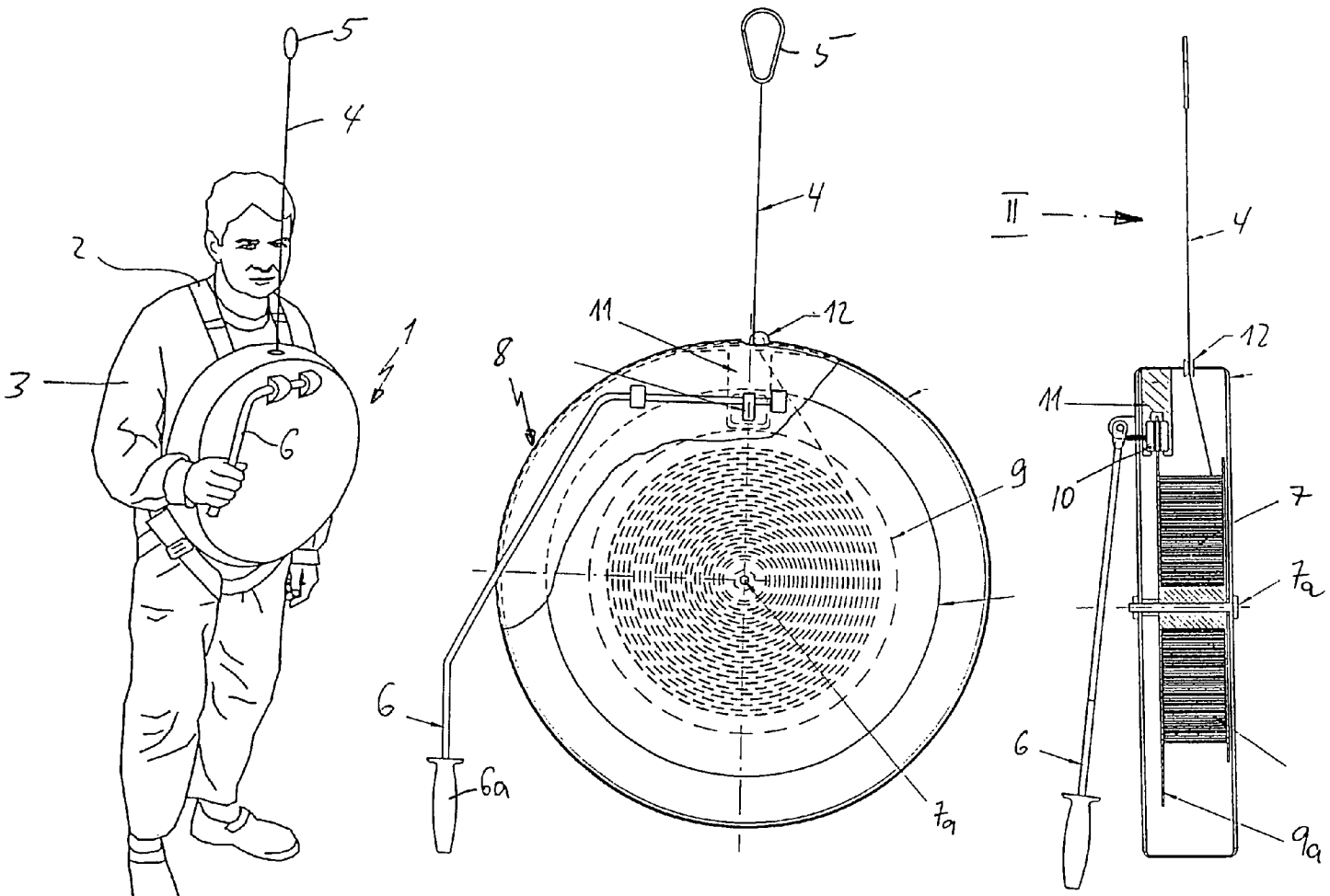
FIG. 1 a simplified representation of a person with an exemplary embodiment of the rappelling device according to the invention, FIG. 2 a side view of the rappelling device according to the invention, partially broken open, FIG. 3 a cross-section along the line III—III in FIG. 2, FIGS. 4 and 5 a simplified representation of a person with another exemplary embodiment of the invention, in a front view and a rear view, FIG. 6 a braking element for a stricture brake, FIG. 7 the same view with a person's hand, FIG. 8 a side view, without a cover, approximately along the arrow VIII in FIG. 9, of the braking device according to a second exemplary embodiment of the invention, FIG. 9 a cross-section approximately along the line IX—IX in FIG. 8, FIG. 10 a side view approximately along the arrow X in FIG. 9, of the braking device without a cover, as well as FIGS. 11 and 12 a transverse and longitudinal cross-section through a modified brake drum.

In the example shown in FIG. 1, the rappelling device, designated in general as 1, is worn by a person 3 on a suspension harness 2. In this connection, it is shown that a piece of the rope that is necessary for rappelling, which is indicated as 4, is pulled out of the device 1; the attaching and securing hook is indicated and carries the reference symbol 5.

At the same time, FIG. 1 shows a brake lever 6 that can be activated by the person, with which the rope 4, [which] is wound up on a drum axle 7*a*, can be released or braked.

In FIG. 2, in a side view, the rope container is shown and designated in general as 8; it consists of a drum on the axle 7 and the rope 4 wound up around it. The one side cheek 9 of the rope drum has a size such that when the rope is fully wound up, there is still an edge 9*a* that can be engaged by brake shoes 10 of the braking device 6, whereby the brake shoes 10 are accommodated in a bearing body 11 and can be activated using the hand lever 6, in such a manner that they can rest against the brake crown 9*a* of the rope disk or can release it, depending on the direction in which the handle 6*a* of the mechanism is activated.

It is understood, of course, that the rope 4 is guided by way of appropriate deflection devices, which are only indicated and designated in general as 12, in such a manner that it can be freely pulled out of the rope container, without problems.

At this point, it should be noted that because of the materials that are possible today, the rappelling device 1 as a whole can be configured to be more compact, on the whole, even in the case of a container having very long rope lengths, but for reasons of the illustration, the size shown in the figures was chosen.

Figure 5:
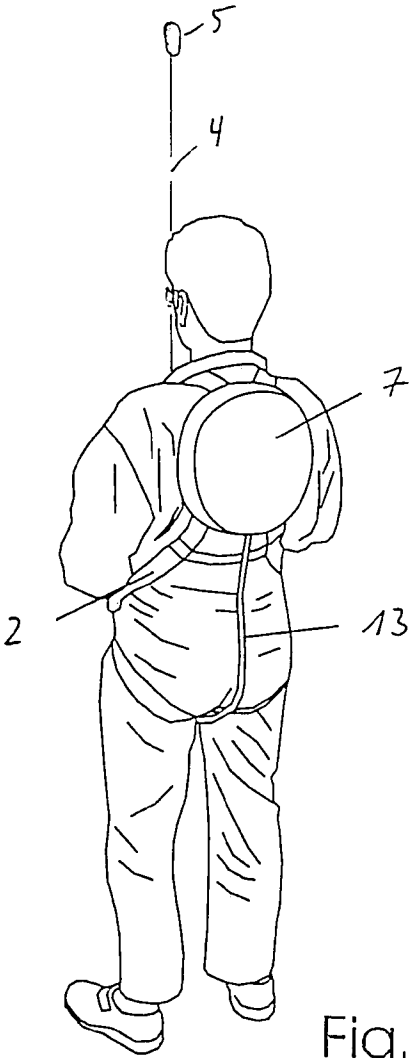
Figure 4:
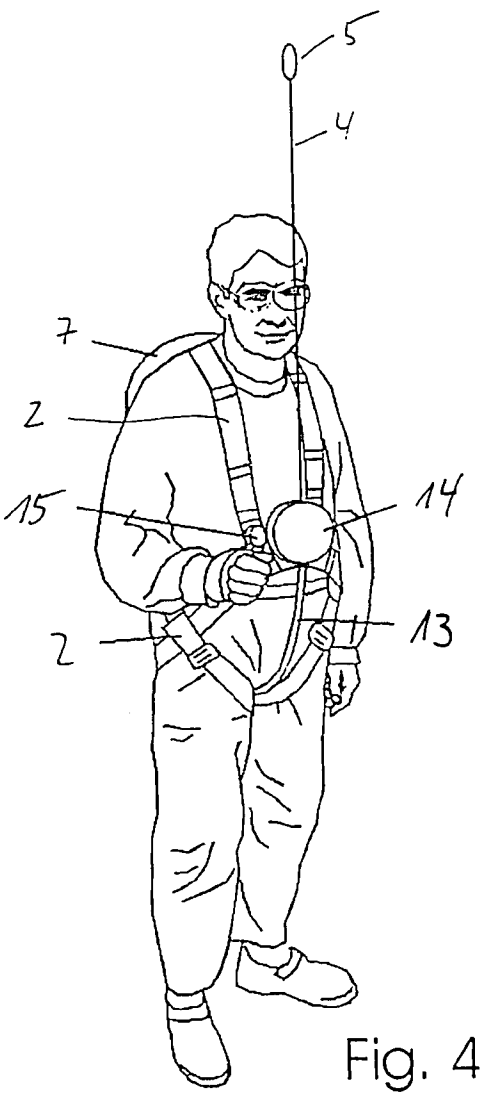

FIGS. 4 and 5 show a modified exemplary embodiment of the invention, whereby the parts that are otherwise the same have the same reference symbols as in FIGS. 1 to 3.

Here, the rope container, i.e. the rope drum 7 is accommodated on the back of the person using it, on the suspension strap 2, whereby the rope 4 is passed from the back of the person using it, by way of a hollow pipe 13, for example past the person's crotch, to the braking device, designated in general as 14, located on the chest side. The braking device 14 described in greater detail above is activated by way of a control device to be held in the hand, designated in general as 15 in FIG. 5, and shown in greater detail in FIGS. 6 and 7.

The embodiment shown in FIGS. 4 and 5 has the advantage, among other things, that the rope drum 7, which generally has to be larger, is not located in the chest region of the person using the device, so that this person can get out of a window or climb over a parapet more easily. In this connection, at the same time, by passing the rope from the back to the chest side of the person using it, the result is achieved that the coupling point, which is essential for equilibrium, from which the forces are introduced into the suspension strap 2, is located approximately in the person's center of gravity.

Figure 10:
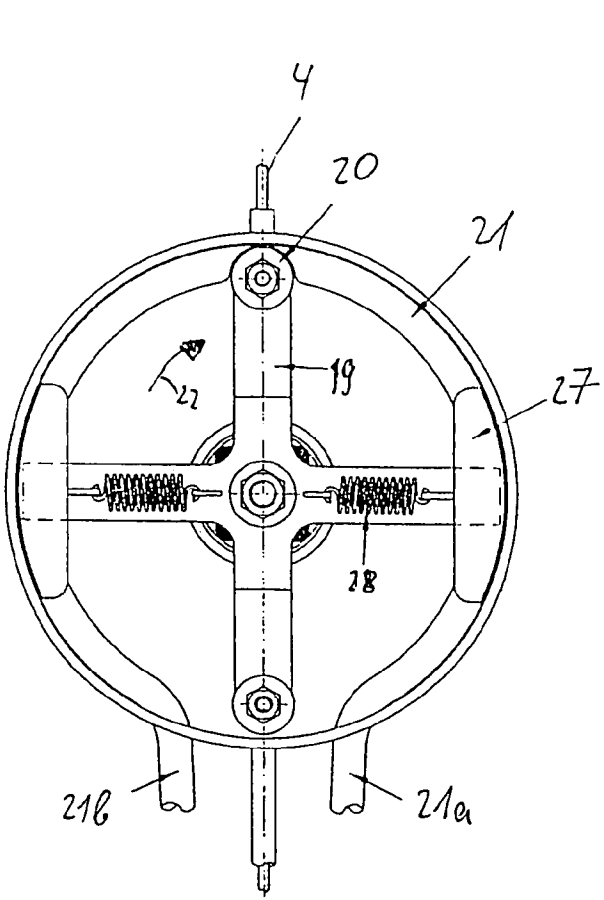
Figure 9:
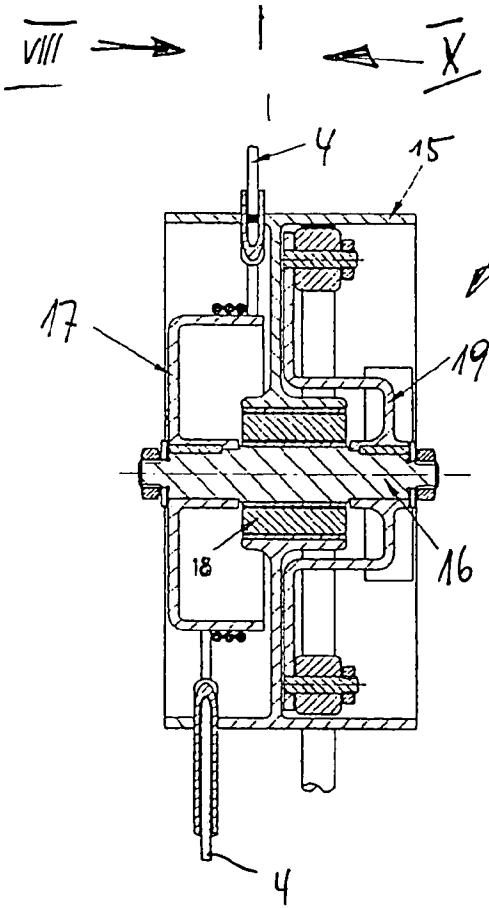
Figure 8:
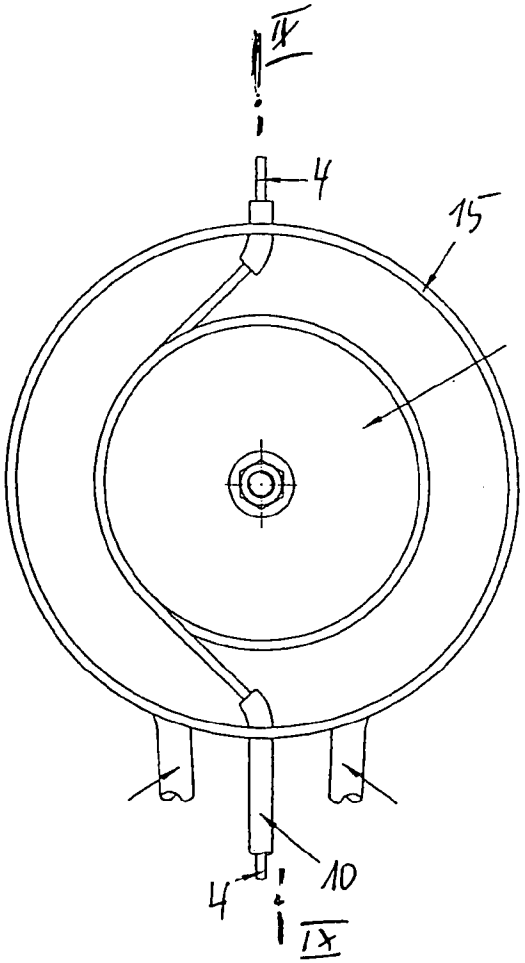

The braking device 14 is shown in greater detail in FIGS. 8 to 10, it is configured as a stricture brake. A rope disk 17, around which the rope 4 is looped several times, is provided in a drum-shaped housing 15, on a common axis 16, and a cross handle 19 connected so as to rotate with it is provided on the centric bearing 18. The rope 4 runs into the braking device 15, loops around the rope drum 17 several times, and leaves it at the top again, in the manner shown in FIG. 4.

Figure 7:
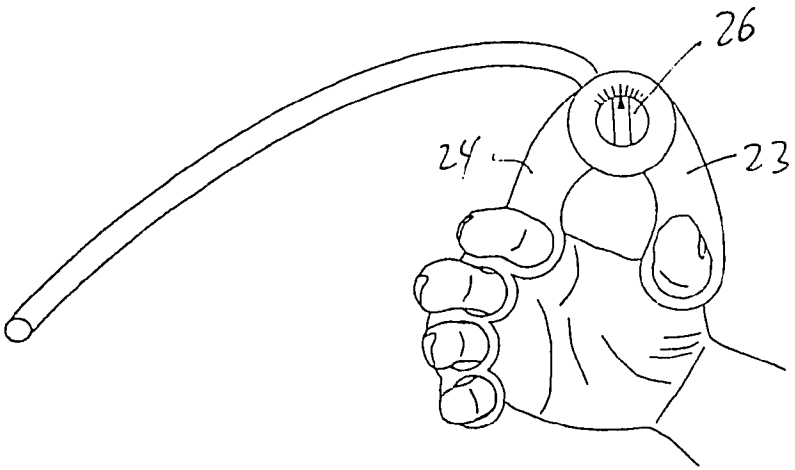

In order to control the speed of rotation of the rope drum 17 and thereby the speed of pulling out the rope and, in turn, thereby the dropping speed of the person hanging from the rope, the cross handle 19 rolls along a hose 21 that is appropriately positioned in the interior of the housing 15 and filled with fluid, with squeezing wheels 20, in such a manner that in reversal of a corresponding stricture pump, here the fluid is made to circulate in front of the squeezing wheels 20; if, for example, the cross handle turns in the direction towards the right, according to the arrow 22 in FIG. 10, the fluid that is located inside the hose 21 is squeezed in the direction towards the exit region 21*a*, then drawn back into the system by way of the inlet 21*b*. In this connection, the brake activity can be controlled by means of a control valve of the handling element 15, as shown in FIGS. 6 and 7.

Figure 6:
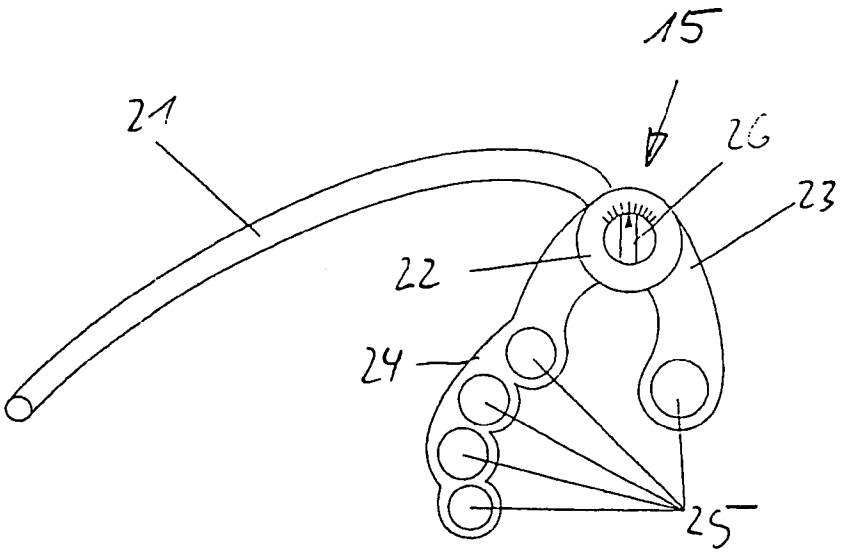

The flow through the hose system 21 can be controlled by way of the control valve, indicated in FIG. 6 and designated as 22. For this purpose, scissors-like handling handles 23 and 24 are provided, which can be moved relative to one another and interact with the throttle designated as 26, in order to control the flow of fluid and thereby the dropping speed.

FIG. 10 shows another safety device on the cross handle 19. Here, brake shoes 27 activated by centripetal force are provided, which are held out of engagement by means of springs 28. If the rope 4 is pulled out too quickly and thereby the cross handle 19 is accelerated too much, the brake shoes 27 lie against the interior of the housing 15 and thereby brake the rope pull-out speed.

Figure 12:
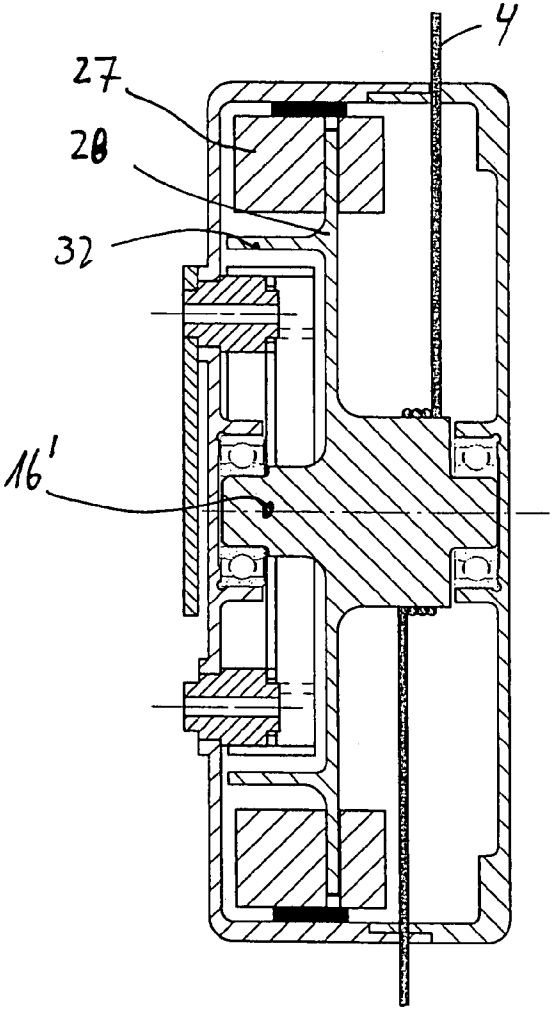
Figure 11:
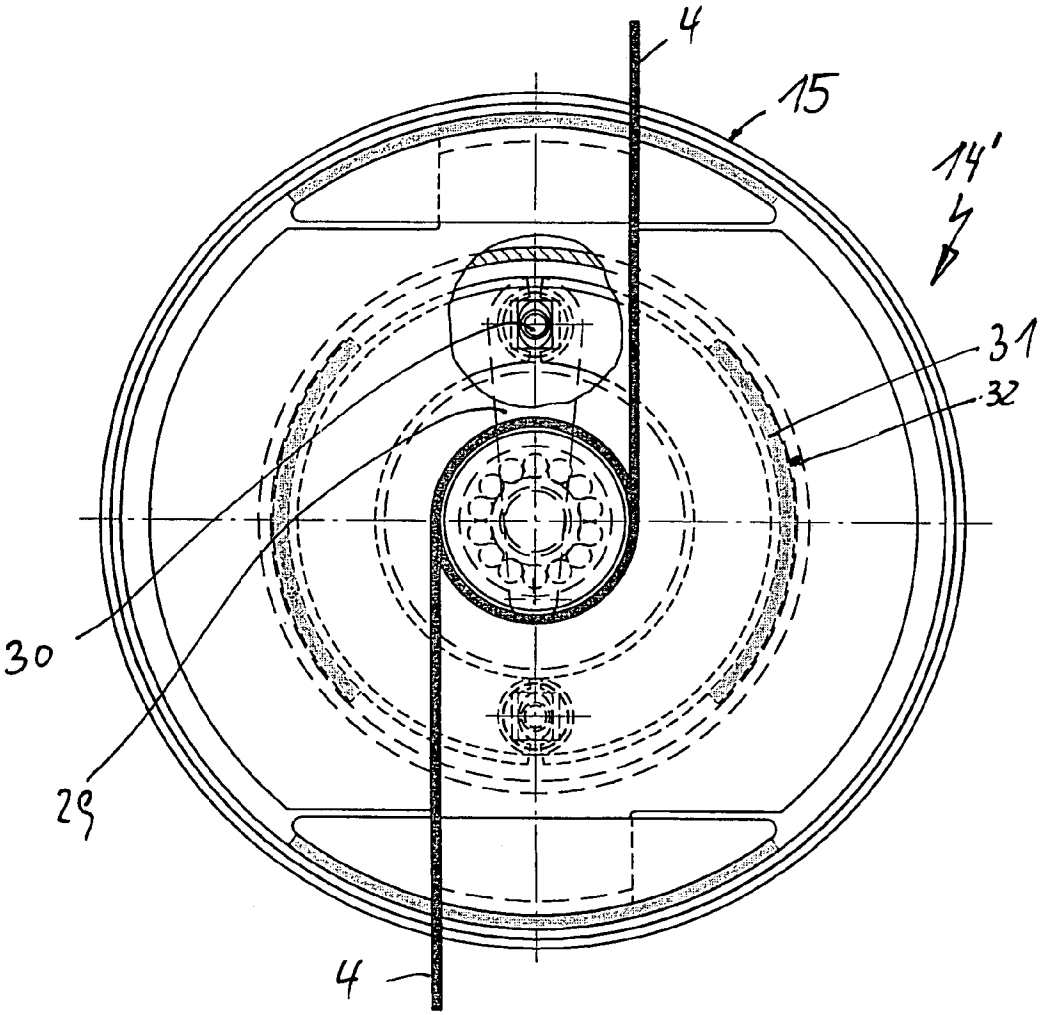

FIGS. 11 and 12 show a modified exemplary embodiment of the rope brake, whereby the reference symbols have been taken over from the preceding figure, in the case of the same components, to the extent that this was possible.

The braking device shown here, designated in general as 14', has a drum-shaped housing 15, in which the rope 4 is wound up with multiple loops on an axle-like body designated as 16', whereby the rope piece 4 leaves the housing 15 at the top and at the bottom, in the manner indicated. A disk body 28, which carries centripetal force brake shoes 27, is molded on in one piece with the axle body 16'; in the case of a high rotation acceleration, the brake shoes make contact on the inside of the housing 15 with their brake pads, exerting a braking effect. A drum brake that can be activated by way of a Bowden cable, not shown in detail, by way of a lever 29 and an excenter 30, is accommodated in the interior of this construction, as is evident from the figures, whereby then, the brake pads 31 tensed by way of the Bowden cable then make contact with a pot-shaped edge 32 of the axle body 16'. It is evident that this brake consists of only a few elements, it is easy to produce at great functionality.

Of course the exemplary embodiments of the invention that were described can still be modified in many different aspects, without leaving the basic idea of the invention. For example, in the exemplary embodiment according to FIGS. 4 and 5, the rope guide can be passed along the side of the body of the person using the device; instead of the disk brakes (FIG. 3) or stricture brakes (FIG. 9), other braking devices can also be provided, for example automatic braking devices or devices that can be activated by means of remote control can be installed, particularly if there is a risk that the person to be rappelled will lose consciousness and thereby no longer be able to continue the rappelling process, or the like.

What is claimed is:

1. A rappelling device for rescuing a person from a high building, tower, or other structure comprising:

(a) a suspension member to be worn by the person;

(b) a rope container comprising a rope drum provided on said suspension member and having a device to release a length of rope, said rope drum being adapted for wearing on a back of the person and comprising a rope guide device for passing the rope to a release position in a chest area of the person; and (c) a braking device provided at an end of said rope guide device.

2. The rappelling device according to claim 1, wherein said suspension member is selected from the group consisting of a suspension strap and a suspension vest.

3. The rappelling device according to claim 1, wherein the rope container comprises a brakeable rope drum on the suspension member.

4. The rappelling device according to claim 1 further comprising a rope brake integrated into the rope drum or separate from the rope drum.

5. The rappelling device according to claim 1, wherein the rope drum and the braking device are configured as a chest pack or a back pack, said braking device being adapted to be activated by the person using the device.

6. The rappelling device according to claim 1, wherein the braking device comprises a disk brake or a stricture brake or a combination thereof.

7. A rappelling device for rescuing a person from a high building, tower, or other structure comprising:

(a) a suspension member to be worn by the person; and (b) a rope container comprising a rope drum provided on said suspension member and having a device to release a length of rope and a rope-braking device, said rope drum being adapted for wearing on a back of the person and comprising a rope guide device comprising a hollow pipe that leads from the rope container to the rope-braking device for passing the rope to a release position in a chest area of the person.

8. A rappelling device for rescuing a person from a high building, tower, or other structure comprising:

(a) a suspension member to be worn by the person;

(b) a rope container comprising a rope drum provided on said suspension member and having a device to release a length of rope, said rope drum being adapted for wearing on a back of the person and comprising a rope guide device for passing the rope to a release position in a chest area of the person;

(c) a rope brake-triggering device comprising a scissor or pliers element operable by a hand of the person and having an opening direction, a closing direction, and a point of rotation; and (d) a metering element arranged at the point of rotation of the element to reduce dropping speed in the closing direction and increase dropping speed in the opening direction.

9. A rappelling device for rescuing a person from a high building, tower, or other structure comprising:

(a) a suspension member to be worn by the person;

(b) a rope container comprising a rope drum provided on said suspension member and having a device to release a length of rope, said rope drum being adapted for wearing on a back of the person and comprising a rope guide device for passing the rope to a release position in a chest area of the person;

(c) a rope drum axle;

(d) a stricture brake on said rope drum axle;

(e) a hose filled with fluid; and (f) a handling element operable by the person comprising a cross handle provided on said rope drum and squeezing elements provided on said cross handle, said squeezing elements acting on said hose to make fluid flow through said hose easier or more difficult.

* * * * *